US011118577B2

(12) United States Patent
Gerz et al.

(10) Patent No.: US 11,118,577 B2
(45) Date of Patent: Sep. 14, 2021

(54) METERING PUMP AND METHOD FOR CONTROLLING A METERING PUMP

(71) Applicant: GRUNDFOS HOLDING A/S, Bjerringbro (DK)

(72) Inventors: Sergei Gerz, Wöschbach (DE); Valeri Kechler, Pforzheim (DE)

(73) Assignee: Grundfos Holding A/S, Bjerringbro (DK)

( * ) Notice: Subject to any disclaimer, the term of this patent is extended or adjusted under 35 U.S.C. 154(b) by 167 days.

(21) Appl. No.: 16/503,047

(22) Filed: Jul. 3, 2019

(65) Prior Publication Data

US 2020/0011309 A1 Jan. 9, 2020

(30) Foreign Application Priority Data

Jul. 6, 2018 (EP) ..... 18182262

(51) Int. Cl.
*F04B 43/04* (2006.01)
*F04B 13/00* (2006.01)
*F04B 49/06* (2006.01)

(52) U.S. Cl.
CPC ..... *F04B 13/00* (2013.01); *F04B 43/04* (2013.01); *F04B 49/065* (2013.01); *F04B 2201/0201* (2013.01); *F04B 2203/0207* (2013.01)

(58) Field of Classification Search
CPC ..... F04B 43/04; F04B 49/065; F04B 2201/0201; F04B 2203/0207; F04B 13/00
See application file for complete search history.

(56) References Cited

U.S. PATENT DOCUMENTS

| | | | | |
|---|---|---|---|---|
| 5,201,636 | A | 4/1993 | Mikulski | |
| 2004/0167738 | A1 | 8/2004 | Miller | |
| 2004/0234377 | A1* | 11/2004 | Bolt | F04B 7/0076 417/44.1 |
| 2007/0041845 | A1* | 2/2007 | Freudenberger | F04B 49/065 417/63 |
| 2015/0159646 | A1 | 6/2015 | Stiehl et al. | |
| 2016/0177937 | A1 | 6/2016 | Liu et al. | |

FOREIGN PATENT DOCUMENTS

| | | | |
|---|---|---|---|
| DE | 102011000569 | A1 | 5/2012 |
| WO | 2018044293 | A1 | 3/2018 |

* cited by examiner

*Primary Examiner* — Patrick Hamo
(74) *Attorney, Agent, or Firm* — McGlew and Tuttle, P.C.

(57) ABSTRACT

A Metering pump includes a displacement element (4), a drive system with an electric drive motor (12) driving the displacement element (4) and a control device (22) controlling the electric drive motor (12). The control device (22) is configured in such a manner that it detects the current position of the displacement element (4), detects the torque (M) of the electric drive motor (12) at several positions of the displacement element (4) and monitors the torque (M) in relation to the position of the displacement element (4), and a method for controlling such metering pump.

15 Claims, 4 Drawing Sheets

METERING PUMP AND METHOD FOR CONTROLLING A METERING PUMP

CROSS REFERENCE TO RELATED APPLICATIONS

This application claims the benefit of priority under 35 U.S.C. § 119 of European Application 18182262.8, filed Jul. 6, 2018, the entire contents of which are incorporated herein by reference.

TECHNICAL FIELD

The invention refers to a metering pump and a method for controlling a respective metering pump.

TECHNICAL BACKGROUND

Metering or dosing pumps are used for feeding and dosing precise amounts of liquid. These metering pumps usually have a moveable displacement element for example in form of a membrane or piston driven by an electric drive motor via a drive system transferring the rotational movement of the motor into a linear movement of the displacement element. For many applications it is required to monitor the pressure of the liquid inside a pumping or metering chamber which volume is varying due to the movement of the displacement element. It is known in the art to use a pressure sensor to detect this pressure.

Furthermore for example from US 2015/0159646 A1 a sensorless disturbance detection in a metering pump is known. According to this prior art the motor torque is monitored and if the motor torque exceeds a certain threshold this is regarded as a disturbance or malfunction of the metering pump.

SUMMARY

In view of this it is the object of the present invention to provide a metering pump allowing a more precise monitoring of the pumping process without the need of a pressure sensor. This object is achieved by a metering pump having the features defined in claim 1 as well as a method for controlling a metering pump having the features defined in claim 13. Preferred embodiments are disclosed in the dependent subclaims, the following description and the enclosed figures.

The metering pump according to the invention comprises a displacement element which is moveable to vary the volume of a displacement or metering chamber. The displacement element is driven by a drive system comprising an electric drive motor. The drive motor may for example cause an oscillating movement of the displacement element in a linear direction. The metering pump according to the invention furthermore comprises a control device for controlling said electric drive motor. For example the control device may vary the speed and/or stroke length carried out by the displacement element by a respective control of the drive motor. Thus the control device can vary the feed or flow rate of the metering pump.

According to the invention the control device is configured in such a manner that it detects the position of the displacement element on its motion path, i. e. the current position of the displacement element. In particular the control device repetitively detects the current position of the displacement pump during the entire movement or along the entire travel of the displacement pump, respectively, in particular during an entire stroke of the displacement element. Furthermore the control device is configured for detecting the torque of the electric drive motor at several distinct positions of the displacement element. Alternatively, it is possible to directly detect the force, i.e. the drive force acting on said displacement element, for example by a force sensor inside the drive system acting on said displacement element. If in the following it is referred to a detected torque, it has to be understood that this always includes the alternative solution to directly detect the force instead of the torque. The several distinct positions of the displacement element may be at least two and preferably a multitude of positions along the travel of the displacement element. This means the control device is configured such that it detects the torque or drive force of the motor preferably at several predefined positions of the displacement element or in predefined time intervals together with detection of the current position at the same moment.

According to a further preferred embodiment it is possible that the control device is configured to continuously or substantially continuously detect the position and the torque or force, respectively. Furthermore the control device is configured to monitor the torque or force in relation to the position of the displacement element. Quasi continues detection of torque or force and position may be a detection in short repeating intervals. The monitoring according to the invention is not just a supervision of a threshold for the torque or force but an analysis of the torque level or force level depending on the position of the displacement element. This allows a more precise analysis and control of the metering pump, since it allows to detect possible malfunctions or an abnormal behavior of the pump and in particular to differentiate between different operating conditions of the pump on basis of a torque plot along the travel of the displacement element. It is for example possible to detect and distinguish bubbles inside the metering chamber, cavitation, a blogged pressure line, leakage and other possible malfunctions of the metering pump.

According to a preferred embodiment said displacement element is a membrane or piston forming one boundary of the metering chamber and moving in an oscillating manner. The membrane may be mechanically driven by a suitable drive system or hydraulically driven in form of a piston-diaphragm-pump.

According to a further preferred embodiment said drive system comprises an eccentric drive which is coupled to the displacement element, for example a membrane or piston, and which is driven by the electric drive motor. The eccentric drive transfers the rotational movement of the electric drive motor into a linear, in particular oscillating movement of the displacement element. The eccentric drive may comprise a connection or piston rod connected to the piston or membrane. This connecting rod may be connected with a radial offset to the rotating shaft of the drive motor to cause an oscillating movement.

The electric drive motor preferably is a brushless DC motor or a stepping motor. These kinds of motors are commonly used to drive metering pumps and allow a control in speed and an exact control of the movement of the displacement element to ensure a precise regulation of the flow rate provided by the metering pump. Furthermore for both, a brushless DC motor and a stepping motor it is possible to derive the torque from the electric parameters of the drive motor. For a stepping motor it is for example described in DE 10 2011 000 569 A1 how to derive the mechanical load acting on a stepping motor. For a brushless DC motor it is possible to detect the motor moment by measuring the current in one or several windings of the motor or by measuring the total current of the motor. In a stepping motor it is possible to detect the motor torque on basis of a measured deviation between a desired rotor angle and a current rotor angle measured. For this a sensor or encoder detecting the current angular position of the rotor may be incorporated in the stepping motor or connected to the rotating motor shaft.

Preferably it is provided at least one position sensor detecting the position of the displacement element and being connected to the said control device. This position sensor may be a sensor detecting a reference position. The further positions of the displacement element along the motion path or travel of the displacement element may be detected relatively starting from this reference position. For example the steps of a stepping motor may be counted. Alternatively in a brushless DC motor the number of rotations may be detected by a sensor inside the motor, for example a hall sensor. On basis of this and with knowledge of the drive design the current positon of the displacement element can be calculated by measuring the relative movement starting from the detected reference positon. Of course it would also be possible to detect the current position of the displacement element on basis of an absolute transducer or encoder connected to the drive motor or the drive system.

Preferably there is provided at least one sensor or encoder for detecting a rotational angle of the electric drive motor. As explained before the detected rotational angle can be used for calculating the motor torque on basis of the deviation between a desired and a current angle. Alternatively or in addition such a sensor for detecting the rotational angle may be used to detect the position of the displacement element as described before. The sensor or encoder for detecting the rotational angle may be a separate encoder, in particular an encoder detecting the absolute angular position of the rotor. Furthermore, the sensor or encoder may be a sensor or encoder just detecting the number of revolutions carried out by the rotor. In particular, the sensor may be an internal sensor of the drive motor, for example a hall sensor used in the drive motor for the motor control. By such design, a separate sensor can be avoided, since the number of revolutions can be counted on basis of a sensor signal, which is needed anyway for the motor control. On basis of the number of revolutions counted by the motor, with knowledge of the further mechanical design of the drive it is possible to detect the membrane position. In particular, the movement of the membrane relative to reference position may be detected and monitored.

According to a further preferred embodiment of the invention, the control device is configured in such a manner that it detects the torque of the drive motor or the drive force acting on the displacement during or along the entire travel of the displacement element. In particular this may be carried out on a continuous basis allowing to continuously monitor the torque in relation to the respective position of the displacement element. It has to be understood that a continuous monitoring may be a quasi continuous monitoring on basis of many torque or force and position values detected in a repeating manner over the stroke of the displacement element. The detection and monitoring of the torque or force over the entire stroke allows to create an indicator-diagram showing the torque or force plotted over the position of the displacement element, i. e. the stroke or travel of the displacement element. The control device or a further monitoring system communicating with the control device may be configured such that they can analyze, in particular continuously analyze such indicator-diagram. Changes occurring in the indicator-diagram in a certain time period or over a certain number of strokes may be an indication for a certain malfunction or operational condition. Changes in the indicator-diagram may be detected by comparing the indicator-diagram with a predefined diagram stored in the control system, in a monitoring device or in a connected storage device or by comparing the detected indicator-diagrams with one another. By this changes or alterations of the indicator-diagram over time can be recognized and analyzed.

In particular, for generating the indicator-diagrams the control device may be provided with a log module logging the torque or force or at least one value derived from the torque or force over the movement or travel of the displacement element. A value derived from the torque or force for example may be a pressure acting on the displacement element. Furthermore the control device may be provided with an analyzing module analyzing the logged torque or force or a derived value for detecting at least one abnormal condition or malfunction of the metering pump. Preferably, such analyzing module may be implemented in a separate analyzing device which is communicating with the control device. In particular there may be provided a centralized analyzing module connected with more than one control device and analyzing the logged torque diagrams, in particular indicator-diagrams as described above. A centralized analyzing device may provide more computing power than the control device of a single metering pump. In particular, the log module and/or analyzing module may be provided by a cloud-computing system allowing to connect the metering pump having a local control device via the internet to a centralized computing system providing the log module and/or analyzing module as described.

According to a further preferred embodiment, the control device of the metering pump comprises a flow detection module, which is configured to detect the effective flow. The flow detection module preferably is configured to detect an effective stroke length of the displacement element from the logged pressure and for calculating the actual flow on basis of said effective stroke length. In an indicator diagram as described before, the opening and closing of the valves can be recognized and on basis of this, the effective stroke length of the pressure stroke between opening and closing of the suction valve or the opening and closing of the pressure valve can be detected. The movement between opening and closing of the respective valve corresponds to the effective stroke length. The volume pumped during the stroke can be calculated by multiplying the effective stroke length by the effective surface $A_{effective}$ of the displacement element. On basis of this, the effective flow rate can be calculated by the flow detection module. By detecting the effective flow rate, it is possible for the control device to feed back control the flow by adapting the speed of the drive motor to achieve a desired flow. Furthermore, certain malfunctions can be detected, if the measured or detected effective flow does not correspond with the desired flow. The control device may be configured to give an alarm signal, if the effective flow rate does not correspond to a desired flow rate.

According to a further preferred embodiment, the control device is configured in such a manner that it derives the current pressure acting on the displacement element, i. e. the current pressure in the metering chamber from the detected current torque of the drive motor or detected drive force. This allows a pressure control without the need of a pressure sensor.

For calculating the pressure advantageously all forces acting on the drive and causing a torque on the drive motor or a measured drive force and which are not resulting from the pressure inside the metering chamber have to be eliminated or subtracted from the measured or calculated torque of the drive motor. In view of this the control device is preferably configured in such a manner that it derives the current pressure acting on the displacement element, i. e. the current pressure in the metering chamber, from the detected current torque of the drive motor in consideration of the friction of the drive, forces resulting from a deformation of the displacement element, inertial forces acting on the drive and/or forces resulting from a deformation of at least one spring element in the drive. The friction of the drive preferably is the entire friction occurring in all moving parts of the drive. A deformation of the displacement element in particular is a deformation of a membrane also producing a resistance force which has to be overcome by the drive moving the displacement element. A spring element may be provided inside the drive acting as a return spring or a spring to even the force or torque curve between pressure and suction stroke. Such spring element may store energy during the suction stroke to give additional forces during the pressure stroke.

The forces resulting from a deformation of the displacement element, and/or inertial forces acting on the drive and/or forces resulting from a deformation of at least one spring element in the drive may be calculated in advance, since they result from the design of the drive and displacement element. Therefore, it is preferred that the control device is configured such that the respective values are calculated and stored in the control device or a connected storage media. Of course these values may depend on the position of the drive or displacement element. Therefore, these forces may be measured or calculated in advance for different positions of the drive or displacement element along its travel. When calculating the pressure inside the metering chamber respective forces may be subtracted from the measured torque of the motor for a certain position.

Preferably in a first step the pressure relevant motor torque is calculated. For example according the following formula:

$$M_{pressure}=M_{motor}-(M_{membrane}-M_{spring}+M_{friction}+M_{acceleration})$$

wherein $M_{pressure}$ is the pressure relevant motor torque, i. e. the motor torque resulting from the pressure inside the metering chamber and acting on the displacement element. $M_{motor}$ is the entire motor torque detected on the motor for example on basis of electrical values as described above. $M_{membrane}$ is the torque acting on the motor resulting from the deformation of a membrane. $M_{spring}$ is the torque acting on the motor resulting from a spring element in the drive which acts as a spring to even the torque curve, i. e. a spring which is relaxed during the pressure stroke. $M_{friction}$ is the part of the torque acting on the motor which results from the entire friction in the drive system. $M_{acceleration}$ is the acceleration torque resulting from the inertial forces acting during acceleration of the mechanical parts of the drive system. As mentioned before the torque components $M_{membrane}$, $M_{spring}$ and $M_{acceleration}$ may be calculated based on the knowledge of the mechanical design of the drive system. On basis of the pressure relevant motor torque $M_{pressure}$ it is possible to calculate the pressure inside a metering chamber for example according the following formula $$p=F_{pressure}/A_{effective}$$

wherein p is the pressure inside the metering chamber, $F_{pressure}$ is the force acting on the displacement element and $A_{effective}$ is the effective surface of the displacement element on which the pressure inside the metering chamber acts in the direction of the movement of the displacement element, for example in the direction of motion of a connection rod of an eccentric drive system. The force $F_{pressure}$ acting on the displacement element can for example be calculated on basis of the pressure relevant motor torque $M_{pressure}$ in knowledge of the length of the lever arm in case that an eccentric drive system is used to drive the displacement element. The pressure force can for example be calculated on basis of the following formula:

$$F_{pressure}=M_{pressure}/I_{lever}$$

wherein $I_{level}$ is the length of the lever arm depending on the current position of the displacement element, for example a membrane.

Instead of calculating the force $F_{pressure}$ acting on the displacement element on basis of the measured torque $M_{pressure}$, it would also be possible to directly measure or detect the force by a force sensor inside the drive system.

Also for the friction or the resulting friction torque ($M_{friction}$) in the drive a constant predefined value may be used. However, according to a further preferred embodiment the control device is configured such that it is able to detect the current friction torque $M_{friction}$ of the entire drive by measuring the torque of the electric drive motor when the displacement element is in or close to a dead-center position. This may be a dead center position at the end of the pressure stroke and/or the dead-center position at the end of the suction stroke. In or close to the dead-center positions in the linear movement of the displacement element no forces are acting in the direction of the linear movement. Therefore there is no torque resulting from any forces acting on the displacement element in this direction. Thus the remaining forces resulting in a torque of the drive motor are the forces resulting from the friction in the drive system. Therefore it is possible to measure the actual friction forces during operation of the metering pump. This allows a more precise compensation of the friction torque when calculating the pressure inside the metering chamber since the actual friction in the system can be considered. In particular changes in the occurring friction, for example due to wear can be taken into consideration.

According to a further special embodiment of the invention, it is possible to measure the friction torque in the system and to monitor the friction torque during operation of the metering pump. The control device may be configured for monitoring and analyzing the detected friction torque. In particular, the control device may be configured to give an alarm, if the friction torque exceeds a predefined threshold. By monitoring the friction in the system, it is possible to detect wear and upcoming problems in an early stage, in particular prior to failure of mechanical parts of the drive system, which would result in a sudden stop or malfunction of the metering pump.

It has to be understood that this measurement of the actual friction in the system in or close to one or both dead-center positions may be used independent from the torque measurement in different positions of the displacement element. Therefore a metering pump having a control device detecting the friction in the drive system by measuring the torque in or close to one or both of the dead-center positions of the displacement element has to be regarded as a separate invention covered by this application. Preferably the control device is configured in such a manner that it detects the torque in at least two different positions of the displacement body, in one position close to or in the dead-center position to measure the friction in the system and in a second position of the displacement body at which the pressure inside the metering chamber should be calculated, wherein the calculation includes an elimination of the friction on basis of the friction measured before at the dead-center position.

Beside the metering pump described the invention refers to a method for controlling a metering pump, in particular a metering pump as described above. The method is used for controlling a metering pump having a displacement element, in particular a displacement element which is moved linearly in an oscillating manner. According to the method a current, i. e. actual position of the displacement element is detected. This may be detected by an absolute measuring system or by a relative measurement starting from a reference position, for example detected by a respective sensor. Furthermore according to the method the torque of an electric drive motor driving the displacement element or the drive force acting on the displacement element is detected at several positions, i. e. at at least two different positions of the displacement element. Furthermore, the torque or force is monitored in relation to the position of the displacement element. In particular, the torque or force may be logged over the varying position of the displacement element along its stroke. This allows to compare torque curves or force curves for different strokes, i. e. a change over a number of strokes or a change over a certain period of time. This allows to detect certain malfunctions as described above. Instead of monitoring and logging the pressure effective torque or drive force it is also possible to monitor or log a value derived from the torque, for example a pressure inside the metering chamber which is derived from the detected torque or force as for example described above.

Preferably the detection of position and torque or force as well as the monitoring of the torque in relation to the position are carried out along an entire travel of the displacement element, i. e. along the entire stroke of the displacement element. Preferably it is a continuous or quasi continuous detection and monitoring which allows to recognize changes of the torque or force curve between different strokes. The method according to the invention, therefore allows to recognize changes occurring over a certain period of time which allows a much better control and detection of different operational conditions or malfunctions compared to the prior art systems just comparing the maximum torque with a predefined threshold.

According to a further preferred embodiment of the method the current pressure acting on the displacement body, i. e. acting in the metering chamber, is calculated on basis of the detected torque or force for at least several point along the travel of the displacement body. Further preferred a continuous pressure calculation is carried out such that it is possible to log a pressure curve over the travel of the displacement body.

When calculating the current pressure or a force or torque resulting from this pressure preferably the friction torque occurring in the drive system is considered and eliminated from the calculation. Preferably the friction torque is measured in the system at a dead-center position. As described above close to the dead-center position no pressure forces are acting on the displacement element such that a remaining torque occurring corresponds to the torque caused by the friction in the system.

According to a further preferred embodiment of the method, the measured friction torque is monitoring during the operation of the metering pump for detecting malfunctions on basis of a detected change of the friction torque. If the friction torque changes, in particular increases, this may be an indicator for wear, for example in the bearings of the drive system. Such a detected change in friction torque may be used to generate an alarm signal informing an operator that a maintenance of the metering pump is necessary. By this, sudden failures resulting in a sudden stop of the metering pump can be avoided.

Further preferred embodiment of the method are described above in context with the metering pump according to the invention. All the method features which are described in context with the metering pump according to the invention have to be regarded as preferred features for the method, too.

BRIEF DESCRIPTION OF THE DRAWINGS

In the following preferred embodiments of the invention are described with reference to the attached figures. In the figures.

DESCRIPTION OF PREFERRED EMBODIMENTS

In the following the metering pump according to the invention and the method according to the invention are described using an example of a diaphragm or membrane pump, respectively. It has to be understood that the invention can be carried out in the same manner with other types metering pumps, for example a metering pump using a piston instead of a membrane. Also a combination of diaphragm or membrane pump, respectively, with a piston pump may be used, for example a piston-diaphragm pump having a hydraulic coupling between a membrane forming a wall of a metering chamber and a piston for compressing a hydraulic fluid for moving the diaphragm.

Figure 1:
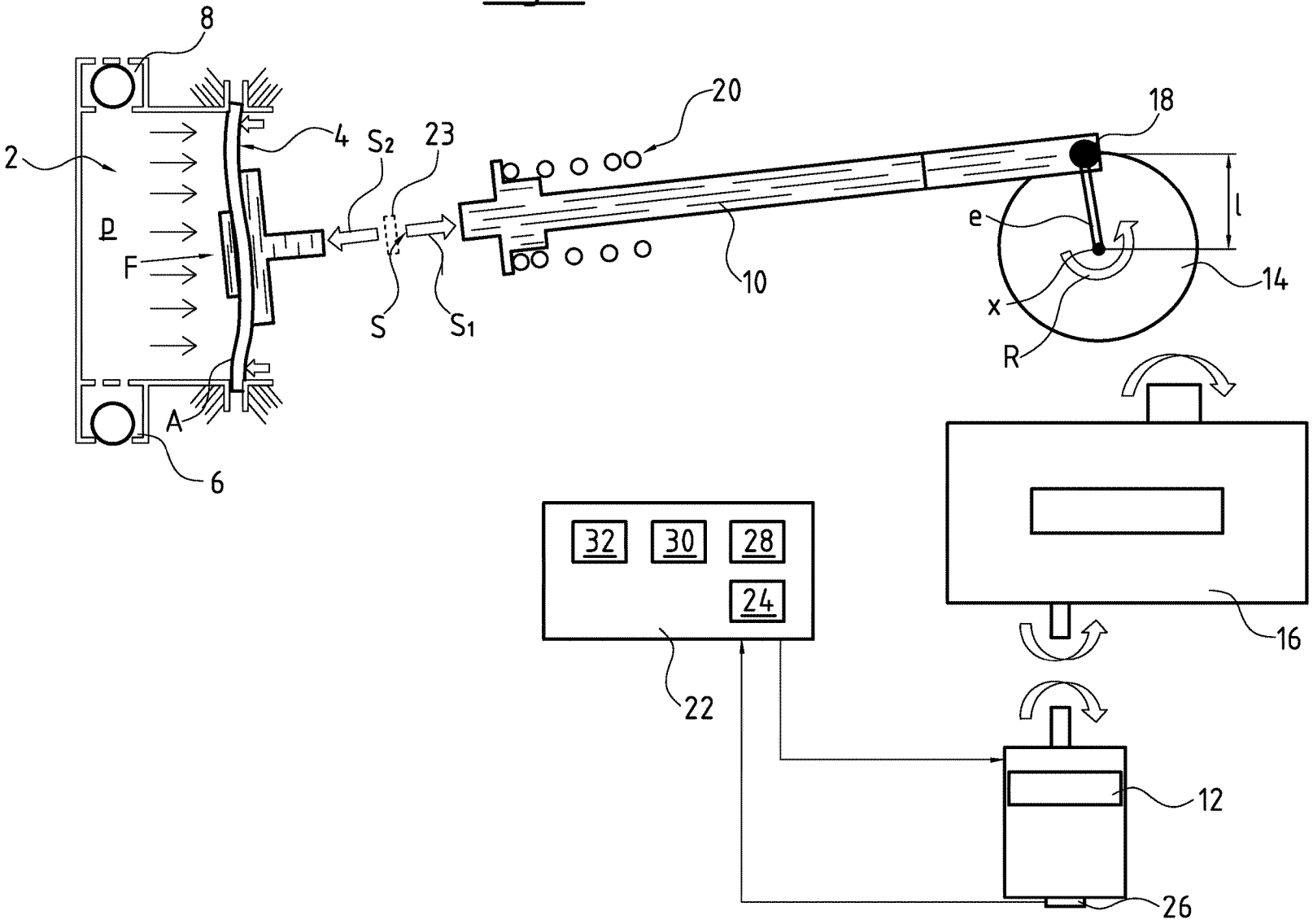
FIG. 1 is a schematic view of a metering pump according to the invention.

The membrane pump schematically shown in FIG. 1 has a metering chamber 2 a sidewall of which is formed by a membrane 4. At the lower side of the metering chamber 2 there is arranged a suction valve 6 whereas on the upper side there is arranged a pressure valve 8. During operation liquid is sucked through the suction valve 6 into the metering chamber 2 and pushed out of the metering chamber 2 through the pressure valve 8. The membrane 4 can be moved in an oscillating manner periodically increasing and decreasing the volume of the metering chamber 2. For this the membrane 4 is connected to a piston or connection rod 10, respectively. By movement of the connection rod 10 the membrane 4 is moved forward and backward between an advanced and a retracted position as indicated by the arrows $S_1$ and $S_2$ in FIG. 1.

The connection rod 10 is part of a drive system having an eccentric drive 14. The drive system comprises an electric drive motor 12 which in this example is coupled to the eccentric drive 14 via a gear drive 16. Although in this example a gear drive 16 is shown it has to be understood that according to different embodiments it would be possible to directly connect the drive motor 12 with an eccentric drive 14. The eccentric drive 14 contains an eccentricity e. This means the connection rod 10 is pivotally connected to the eccentric drive 14 at a connection point 18 which is distanced from the rotational axis x by the eccentricity e. This causes a linear movement of the connection rod 10 in the direction S if the eccentric drive 14 is rotated in the rotational direction R. In this example furthermore a spring 20 is arranged in the drive. The spring 20 is a compression spring connected to the connecting rod 10 such that the spring 20 is compressed when the connecting rod 10 is moved backwards in direction $S_1$ moving the membrane 4 in the retracted position. By this the spring 20 can accumulate energy during the suction stroke. This energy is released during the pressure stroke 20 when the connecting rod together with the membrane 4 is moved in the forward, i. e. advanced position in the direction $S_2$. By this the spring 20 soothes the torque to be applied by the electric drive motor 12 during the entire stroke. It has to be understood that it is also possible to arrange a spring being compressed during the pressure stroke and acting as a return spring. Furthermore, the invention may also be realized with a drive without a spring.

The electric drive motor 12 is controlled by a control device 22. The control device 22 in particular controls the speed of the drive motor 12 to control the flow rate of the metering pump, i. e. the amount of liquid is pumped by the membrane 4 through the metering chamber 2 per unit of time.

According to the invention the control device 22 monitors the position of the membrane 4 as well as the torque to be applied by the drive motor 12. For this the control unit 22 contains a torque detection module 24. The torque detection module 24 may be configured for example such that it derives the torque acting on the drive motor 12 from the motor current applied to the electric drive motor 12. The drive motor 12 in this example preferably is a brushless DC motor. However, in case that a stepping motor should be used it would for example be possible to derive the motor torque on basis of a measured deviation between a desired rotor angle and a current rotor angle measured. For this a sensor or encoder 26 may be attached to or implemented into the electric drive motor 12 to detect the angular position of the rotor of the drive motor 12. The encoder 26 has a signal connection with the control device 22 such that the sensor signals from the encoder 26 are forwarded to the control device 22. Furthermore, in an alternative embodiment, it would also be possible to detect the torque of a stepping motor without use of a sensor, for example as described in DE 10 2011 000 569 A1.

Instead of detecting the motor torque, it would be possible to directly measure the drive force acting on the displacement element 4, for example by a force sensor 23, as indicated in FIG. 1. It has to be understood that the use of a force sensor 23 which directly detects the drive force acting in opposite direction to the force F shown in FIG. 1 would be an alternative solution to the detection of the motor torque. In the following, preferred embodiments or options of the invention are described with reference to the detection of the motor torque. However, they may be realized in a similar manner on basis of the direct detection of the drive force.

Figure 2:
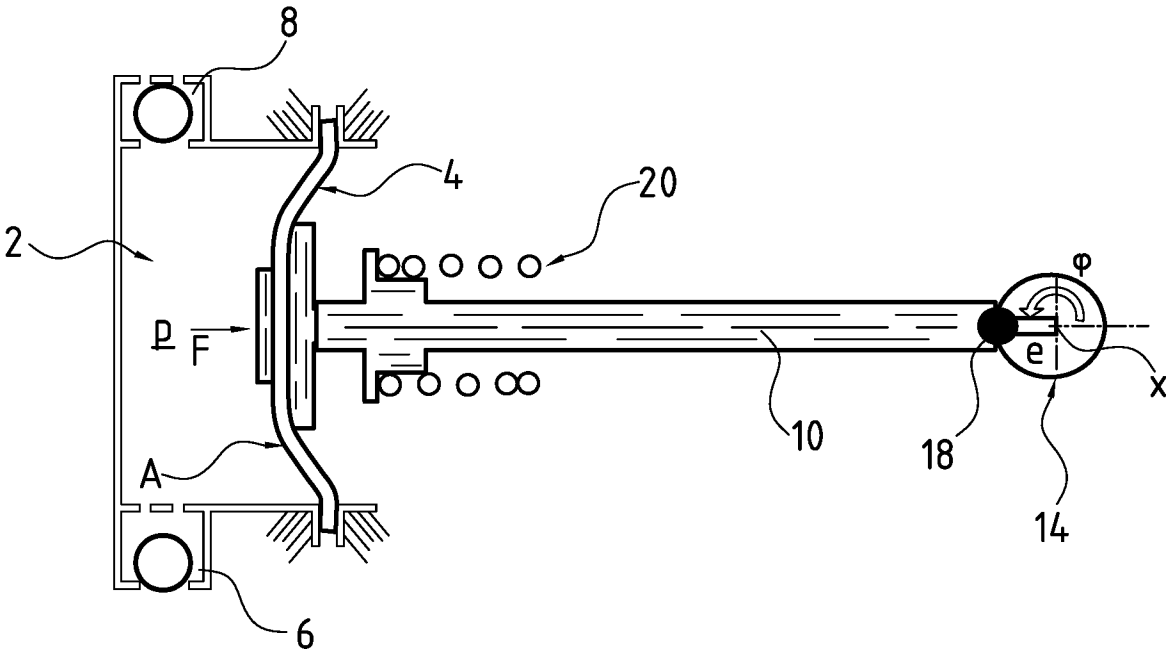
FIG. 2 is a schematic view of metering pump according FIG. 1 with the membrane in a first dead-center position being the advanced position of the membrane.
Figure 3:
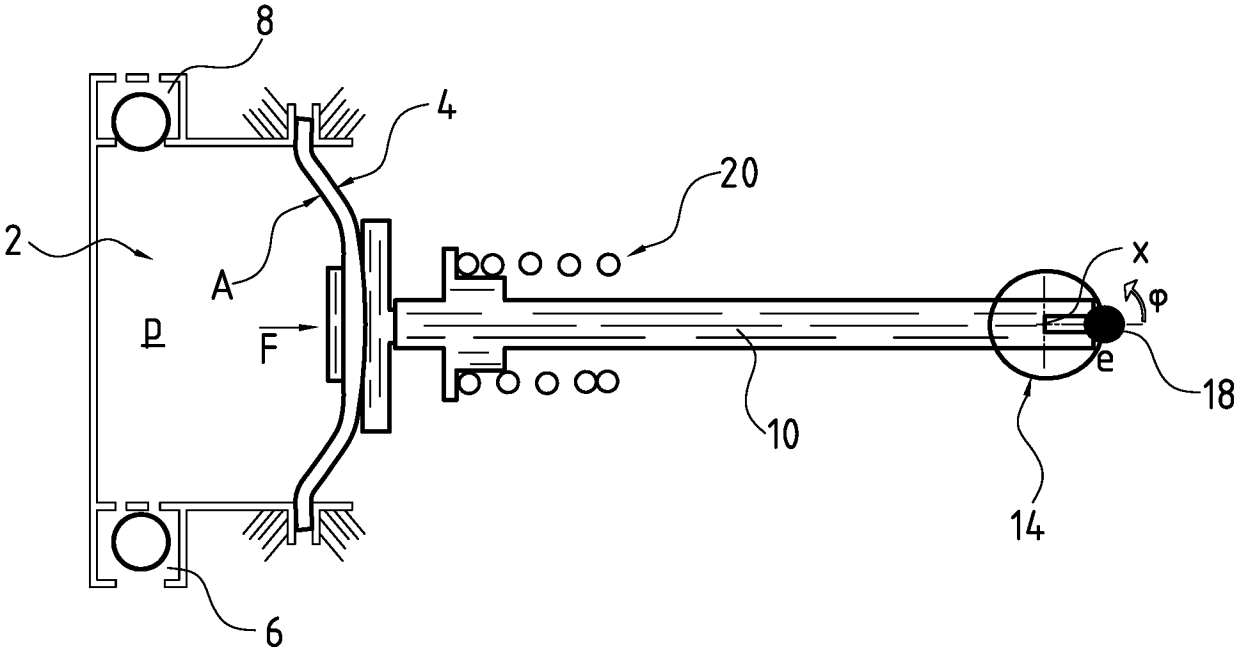
FIG. 3 is a schematic view of a metering pump according FIGS. 1 and 2 with the membrane in the second dead-center position being the retracted position of the membrane.

Furthermore, on basis of the signal of encoder 26, the control device 22 can detect the current position of the membrane 4 between the advanced position shown in FIG. 2 and the retracted position shown in FIG. 3. This is possible because of the fixed mechanical coupling between membrane 4 and electric drive motor 12 via gear drive 16 and eccentric drive 14. It has to be understood that for detecting the membrane position further or different sensors may be used which signals are received by the control device 22.

The encoder 26 may be an absolute encoder detecting the absolute rotational angle φ. However, it would also be possible to use a relative encoder or transducer detecting the rotational angle or actual position of the membrane 4 along the axis of movement S relatively starting from a reference position detected by reference sensor in the system.

Figure 4:
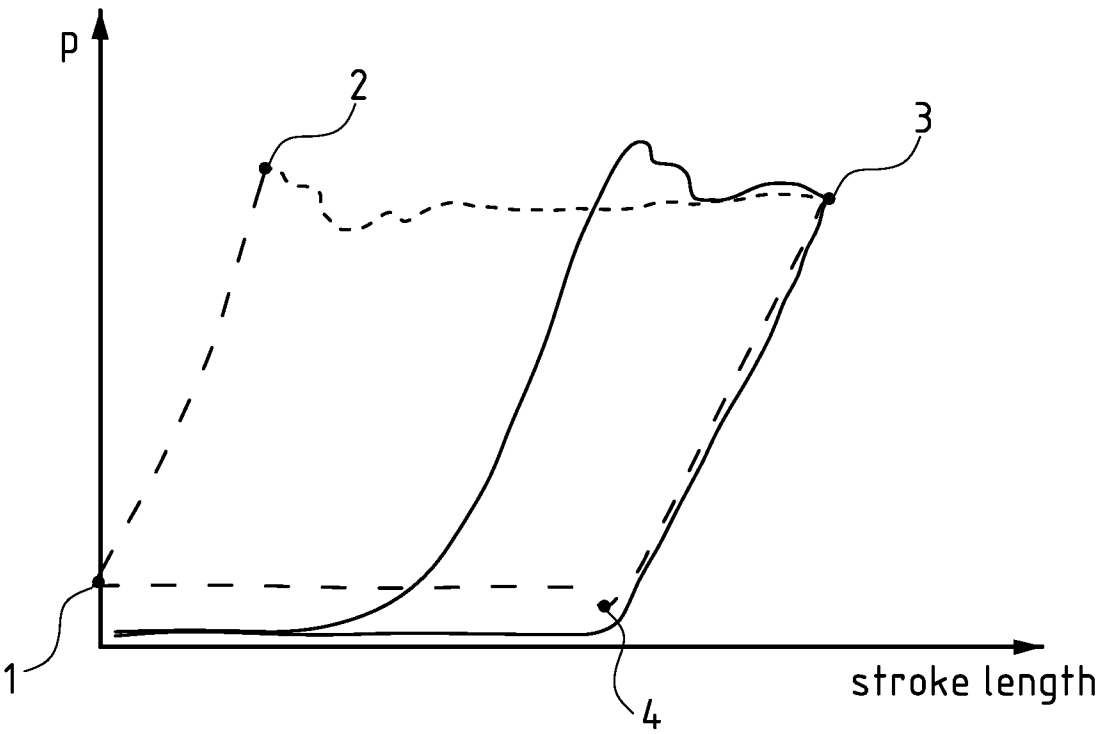
FIG. 4 is a graph as an example for an indicator diagram.

Based on the position signal representing the current position of the membrane 4 and the torque derived from the torque detection module 24 an indicator diagram as shown in FIG. 4 is created by a log module 28 of the control device 22. In such indicator diagram the detected torque or a pressure p acting inside the metering chamber 2 is plotted over the detected position of the membrane 4 forming a displacement element, i. e. over the stroke length. To detect the pressure p the control device 22 may contain a pressure detection module 30 calculating the pressure on basis of the detected torque. On basis of the detected torque the force acting on membrane 4 can be calculated. Then, with knowledge of the size of membrane 4 pressure p acting on the membrane 4 inside the metering chamber can be derived. It has to be understood that the described modules of the control device 22 preferably are provided as software modules. The modules may be implemented into a control device 22 arranged directly on the drive motor 22 for example inside an electronic housing of the drive motor 12. However, it would also be possible to arrange at least parts of the control device 22, e. g. at least one or more of the modules separately to the metering pump and to connect these modules with the control device of the metering pump via a network connection, like the internet. Thus, parts of the control device or modules may be realized by cloud-computing, i.e. in a centralized computing system connected to the metering pump via the internet. In particular the log module 28 may be arranged in a centralized computing system. Furthermore an analyzing module 32 is provided in the control device 22 for analyzing the curves or indicator diagram created by the log module 28. Also this analyzing module 32 may either be arranged in a control device 22 directly integrated into the metering pump, i. e. arranged in an electronic housing of the metering pump, or arranged distanced, preferably in a centralized computer system.

The pressure inside the metering chamber 2 may be calculated by the pressure detection module 30 on basis of the pressure effective motor torque $M_{pressure}$ provided by the electric drive motor 12 and acting on the eccentric drive 14. Depending on the rotational angle φ (see FIGS. 2 and 3) the eccentricity e provides a lever I between the rotational axis x and the connection point 18 of the connection rod 10. The lever I is responsible for the force F acting on the membrane 4. This force F divided by the size of the membrane 4, i. e. the effective surface $A_{effective}$ is the resulting pressure p inside the metering chamber 2. The effective surface $A_{effective}$ influencing the force F acting on the membrane 4 and the connection rod 10 is the area of the membrane surface 4 in a plane perpendicular to the longitudinal axis of the connection rod 10. Thus the pressure can be detected on basis of electrical parameters of the drive motor 12 without the necessity to provide a pressure sensor in the fluid system.

To calculate the pressure effective torque $M_{pressure}$ the torque in particular components resulting from friction, inertial forces, elasticity of the membrane 4 and the spring 20 should be evaluated and eliminated in the pressure calculation by the torque detection module 24. The inertial forces as well as a spring force provided by the spring 20 and the forces resulting from deformation and elasticity of membrane 4 can be calculated and are preferably stored inside the control module 22 in a table in dependency of the rotational angle φ which is detected by the encoder 26. The detection of the membrane position or stroke position may also be carried out without the encoder 26. For example, an internal sensor of a motor like a brushless DC motor, for example a hall sensor inside the motor, can be used to count the number of rotations carried out, in particular starting from a reference position, which may be detected by a further sensor.

According to the invention the torque component resulting from the friction in the drive system, i. e. the friction torque $M_{friction}$ is not regarded as being constant but measured in the system. The friction torque $M_{friction}$ can be detected by the torque detection module 24 close to the dead-center position of the membrane 4 as shown in FIGS. 2 and 3. In FIGS. 2 and 3 the gear system 16 and the drive motor 12 as well as the control device 22 are not shown for simplification. It can be seen that in the dead-center positions and close to the dead-center positions as shown in FIGS. 2 and 3, respectively, the level I is zero. FIG. 2 shows the advanced membrane position for a rotational angle φ 180°, whereas FIG. 3 shows the retracted membrane positon for a rotational angle φ=0°. Since the lever I is zero the pressure p inside the metering chamber 2 and the resulting force F acting on the membrane 4 cannot provide any torque about the rotational axis x anymore. Also the torque provided by the spring force resulting from the spring 20 and the force resulting from the deformation of membrane 4 are depending on the lever I such that in the dead-center positions the torque components $M_{membrane}$ and $M_{spring}$ resulting from these forces are also approximately zero. The torque component $M_{acceleration}$ resulting from the inertial forces at the dead center positions or close to the dead center positions may also be approximately zero. However, even if this torque component does not become zero at the dead center position, it can be eliminated, since it can be calculated in advance and the torque component $M_{acceleration}$ as calculated may be subtracted from the measured torque at the dead center position, so that the influence of this torque component can be eliminated. This means the only remaining forces in the system resulting in a torque acting on the drive motor 12 are the friction forces. This means that the torque detected by the torque detection module 24 when the membrane 4 is in or close to one of the two dead-center positions corresponds to the friction torque $M_{friction}$ resulting from the friction in the drive system. Thus it is possible to measure the actual friction torque $M_{friction}$ in the system which allows a more precise calculation of the pressure relevant torque $M_{pressure}$ on basis of which the pressure p inside the metering chamber 2 may be derived or calculated.

It is preferred that control device 22 continuously monitors the pressure relevant torque $M_{pressure}$ and the derived pressure p in relation to the membrane position 4. On basis of this, as described above an indicator-diagram showing the pressure p over the membrane positon can be created (FIG. 4). The analyzing module 32 is configured for analyzing these indicator-diagrams during the entire operation of the metering pump. In particular the analyzing module 32 configured for detecting changes in the pressure curve over time allows to detect different malfunctions or certain operational conditions of the metering pump. According to the invention this can be carried out without the need of a pressure sensor detecting the actual fluid pressure. Instead the fluid pressure can be derived from the motor torque.

FIG. 4 shows an example for an indicator diagram showing a plot of pressure p over the stroke length of a pressure stroke of the membrane 4, i. e. a stroke moving the membrane 4 towards its advanced position decreasing the volume of the metering chamber 2. Instead of plotting the pressure over the stroke length it would also be possible to directly plot the pressure effective torque $M_{pressure}$ over the stroke length. In FIG. 4 the dotted line shows the normal pressure curve for normal operation of the metering pump without any disturbance. On the other hand the continuous line shows a pressure curve resulting when cavitation occurs inside the pressure chamber. Thus by comparing different torque or pressure curves over the stroke length it is possible to detect certain malfunctions like cavitation of the metering pump. This analyze is carried out by the analyzing module 32 by either directly comparing torque or pressure curves detected over time or by comparing a detected pressure or torque curve with a sample curve stored in a data base connected or integrated with the analyzing module 32.

Furthermore, the analyzing module 32 is configured to detect characterizing points on the pressure curve of the indicated diagram as shown in FIG. 4 on the curve drawn in dotted line and showing a curve of a normal operation. There may be detected for example four characterizing points 1, 2, 3 and 4 referring to the opening and closing of the suction valve 6 and the pressure valve 8. At the point 1, the suction and the discharge valve are closed. At point 2, during the pressure stroke, the discharge valve, i.e. the pressure valve 8 is opened. At the end of the pressure stroke at point 3, the pressure valve 8 is closed. At this point, there begins the suction stroke. At point 4 during the suction stroke, the suction valve 6 is opened. At the end of the suction stroke at point 1, the suction valve is closed again. In particular, points 2 and 4 can be recognized on the pressure curve, since there the pressure curve makes a deflection, which can be detected by the analyzing module 32. The stroke length between points 2 and 3 corresponds to an effective hydraulic discharge stroke, whereas the stroke length between points 1 and 4 corresponds to an effective hydraulic suction stroke. On basis of these effective stroke lengths, it is possible to calculate the effective or actual stroke volume $V_H$ according to the following formula:

$$V_H = S_h * A_{effective},$$

wherein $s_h$ is the effective stroke length, i.e. the effective hydraulic discharge stroke or the effective hydraulic suction stroke, as described above and $A_{effective}$ is the effective membrane surface.

On basis of the effective stroke volume $V_H$, the effective flow may be calculated by multiplying the stroke volume $V_H$ by the frequency of the movement of the displacement element 4. This measurement or detection of the effective flow rate allows a feedback-control by adapting the speed of the drive motor 12 by the control device 22 to achieve a desired flow rate. Furthermore, malfunctions may be detected, if the desired flow rate cannot be achieved. In this case, the control device 22 may signalize an alarm.

LIST OF REFERENCE NUMERALS

2—metering chamber
4—membrane
6—suction valve
8—pressure valve
10—connection rod
12—drive motor
14—eccentric drive
16—gear drive
18—connection point

20—spring
22—control device
23—force sensor
24—torque detecting module
26—encoder
28—log module
30—pressure detection module
32—analyzing module
S—arrows showing membrane movement, direction of membrane motion
$S_1$—backward movement
$S_2$—forward movement
e—eccentricity
x—rotational axis
R—rotational direction
p—pressure
I—lever
φ—rotational angle
F—force
A—area
M—torque

What is claimed is:

1. A metering pump comprising:
a displacement element;
a drive system comprising an electric drive motor driving said displacement element and a control device controlling said electric drive motor, wherein said control device is configured to:
detect a current position of the displacement element;
detect a torque of the electric drive motor or to detect a drive force acting on the displacement element at several positions of the displacement element;
monitor the torque or force in relation to the position of the displacement element; and
derive the current pressure, acting on the displacement element, from the detected current torque of the drive motor or detected drive force, wherein the control device is configured such that the forces resulting from a deformation of the displacement element, inertial forces acting on the drive and/or forces resulting from a deformation of at least one spring element in the drive are represented by predefined values which are stored in the control device.

2. A metering pump according to claim 1, wherein said displacement element is a membrane or a piston.

3. A metering pump according to claim 1, wherein said drive system further comprises an eccentric drive coupled to the displacement element and driven by the electric drive motor.

4. A metering pump according to claim 1, wherein the electric drive motor is a brushless DC motor or a stepping motor.

5. A metering pump according to claim 1, wherein at least one position sensor detects the position of the displacement element and is connected to said control device.

6. A metering pump according to claim 1, wherein at least one sensor detects a rotational angle of the electric drive motor.

7. A metering pump according to claim 1, wherein the control device is configured to detect the torque or the force along an entire travel of the displacement element.

8. A metering pump according to claim 1, wherein the control device is provided with a log module logging the torque or force or a value derived from the torque or the force over a travel of the displacement element and with an analyzing module analyzing a logged pressure for detecting at least one abnormal condition of the metering pump.

9. A metering pump according to claim 8, wherein the control device comprises a flow detection module detecting an effective stroke length of the displacement element from the logged pressure and calculating the actual flow on basis of the effective stroke length.

10. A metering pump according to claim 1, wherein the control device is configured to derive a current pressure acting on the displacement element from the detected current torque of the drive motor in consideration of friction of the drive, forces resulting from a deformation of the displacement element, inertial forces acting on the drive and/or forces resulting from a deformation of at least one spring element in the drive.

11. A metering pump according to claim 1, wherein the control device is configured such that the control device detects a current friction torque of the entire drive by measuring the torque of the electric drive motor when the displacement element is in a dead-center position.

12. A method for controlling a metering pump comprising a displacement element and a drive system comprising an electric drive motor driving said displacement element and a control device controlling said electric drive motor, wherein said control device is configured to detect a current position of the displacement element, to detect a torque of the electric drive motor or to detect a drive force acting on the displacement element at several positions of the displacement element and to monitor the torque or force in relation to the position of the displacement element, the method comprising the steps of:
detecting a current position of the displacement element;
detecting a torque of the electric drive motor or a drive force acting on the displacement element at several positions of the displacement element; and
monitoring the torque in relation to the position of the displacement element, wherein a current pressure acting on the displacement element is calculated based on the detected torque or the force for at least several points along the travel of the displacement element, wherein a current friction torque is measured when the displacement element is in a dead-center position as a basis for the calculation of the pressure.

13. A method according to claim 12, wherein the detection of position and torque as well as the monitoring of the torque in relation to the position are carried out along an entire travel of the displacement element.

14. A method according to claim 12, wherein the friction torque is monitored during operation of the metering pump for detecting malfunctions based on a detected change of the friction torque.

15. A metering pump comprising:
a displacement element;
a drive system comprising an electric drive motor driving said displacement element and a control device controlling said electric drive motor, wherein said control device is configured to:
detect a current position of the displacement element;
detect a torque of the electric drive motor or to detect a drive force acting on the displacement element at several positions of the displacement element; and
monitor the torque or force in relation to the position of the displacement element, wherein the control device is configured such that the control device detects a current friction torque of the entire drive by measuring the torque of the electric drive motor when the displacement element is in a dead-center position.

* * * * *